United States Patent [19]

Thomas

[11] Patent Number: 4,853,594

[45] Date of Patent: Aug. 1, 1989

[54] ELECTROLUMINESCENT LAMP

[75] Inventor: Alan C. Thomas, Woodstock, Conn.

[73] Assignee: Rogers Corporation, Rogers, Conn.

[21] Appl. No.: 230,569

[22] Filed: Aug. 10, 1988

[51] Int. Cl.[4] ..... H05B 33/10; H05B 33/26

[52] U.S. Cl. ..... 313/503; 427/66; 428/917

[58] Field of Search ..... 313/503; 427/66; 428/690, 917; 252/520

[56] References Cited

U.S. PATENT DOCUMENTS

| | | | |
|---|---|---|---|
| 2,721,153 | 10/1955 | Hopf et al. | 117/212 |
| 2,752,331 | 6/1956 | Dittman et al. | 260/87.7 |
| 2,866,764 | 12/1958 | West et al. | 260/30.4 |
| 2,875,105 | 2/1959 | Troester | 117/218 |
| 2,907,882 | 10/1959 | Patten | 250/80 |
| 2,941,104 | 6/1960 | Swindells | 313/108 |
| 2,990,294 | 6/1961 | Long | 117/75 |
| 3,010,044 | 11/1961 | Cerulli | 313/108 |
| 3,247,414 | 4/1966 | Levetan | 313/108 |
| 3,315,111 | 4/1967 | Jaffe et al. | 313/108 |
| 3,421,037 | 1/1969 | Dymon | 313/108 |
| 3,470,014 | 9/1969 | Koblitz et al. | 117/72 |
| 3,490,946 | 1/1970 | Wolff | 117/235 |
| 3,498,939 | 3/1970 | Schier et al. | 260/19 |
| 3,787,238 | 1/1974 | Juliano | 117/335 R |
| 3,850,631 | 11/1974 | Tamai | 96/1.5 |
| 3,935,333 | 1/1976 | Muneoka et al. | 427/49 |
| 4,045,636 | 8/1977 | Yoder et al. | 200/292 |
| 4,121,001 | 11/1978 | Gotcher et al. | 428/35 |
| 4,159,559 | 7/1979 | Robinson, Sr. | 29/25.14 |
| 4,187,339 | 2/1980 | Cayrol | 428/203 |
| 4,205,116 | 5/1980 | Van Landeghem | 428/409 |
| 4,266,223 | 5/1981 | Frame | 340/719 |
| 4,273,829 | 6/1981 | Perreault | 428/383 |
| 4,278,913 | 7/1981 | Kagami | 313/495 |
| 4,282,117 | 8/1981 | Muramoto et al. | 252/508 |
| 4,314,231 | 2/1982 | Walty | 338/328 |
| 4,336,120 | 6/1982 | Sakakura | 204/192 SP |
| 4,376,145 | 3/1983 | Frame | 428/195 |
| 4,417,174 | 11/1983 | Kamijo et al. | 313/502 |
| 4,455,324 | 6/1984 | Kamiso et al. | 427/66 |
| 4,623,601 | 11/1986 | Lewis et al. | 430/69 |
| 4,638,111 | 1/1987 | Gay | 136/249 |
| 4,663,495 | 5/1987 | Berman et al. | 136/248 |

FOREIGN PATENT DOCUMENTS 1059678 7/1979 Canada .

OTHER PUBLICATIONS

Encyclopedia of Polymer Science and Technology, vol. 14 (1971), pp. 600–610.

Howard, Webster E., "Electroluminescent Display Technologies and their Characteristics", Proceedings of the SID, vol. 22, No. 1 (1981), pp. 47–56.

"Technical Date-Solvents for Kynar", Pennwalt Corporation, Jan. 31, 1974.

"Kynar", Pennwalt Corp.

"Technical Date-Kynar", Pennwalt Corporation, Apr. 1, 1970.

*Primary Examiner*—Donald J. Yusko

*Assistant Examiner*—Sandra L. O'Shea

[57] ABSTRACT

An electroluminescent lamp including a phosphor layer disposed between corresponding lamp electrodes that are adapted to apply an excitation potential to cause the phosphor layer to emit light, the front lamp electrode being light-transmsisive to radiation from the phosphor layer, has an improved front lamp electrode consisting of a thin layer of light-transmissive binder containing a distribution of discrete gallium-doped zinc oxide particles. A method of forming the lamp is also described.

10 Claims, 1 Drawing Sheet

ELECTROLUMINESCENT LAMP

BACKGROUND OF THE INVENTION

This invention relates to electroluminescent lamps.

Electroluminescent lamps are typically formed of a phosphor particle-containing layer disposed between corresponding wide area electrodes, adapted to apply an excitation potential across the phosphor particles. A barrier against moisture penetration, in the form of a film, is bonded to the electrodes that form the exterior of the lamp to prevent premature deterioration of the phosphors due to moisture intrusion.

It has been known to form the semi-transparent front electrode of such prior art lamps of particles of conductive material such as indium oxide or silver dispersed in a binder material. The selection of conductive materials suitable for use in the light transmissive front electrode is limited by the requirement of electrical conductivity, and the desire for the maximum transmissivity of available light. Aesthetics are also a consideration, it being desirable for an electroluminescent lamp, used, e.g., in an automobile, to have a consistent color, typically white, whether the lamp is on or off. In typical prior art lamps, it has been necessary to employ non-conductive, diffuse covering layers to achieve the desired color in the "off" mode, with resultant diminished brightness of the electroluminescent lamp in the "on" mode.

SUMMARY OF THE INVENTION

According to the invention, an improved electroluminescent lamp comprises a phosphor layer disposed between corresponding lamp electrodes that are adapted to apply an excitation potential to cause the phosphor layer to emit light, the front lamp electrode being light-transmissive to radiation from the phosphor layer, the front lamp electrode comprising a thin layer of light-transmissive binder containing a distribution of discrete gallium-doped zinc oxide particles.

Preferred embodiments of the lamp of the invention may include one or more of the following features. The average size of the particles is less than about 45 μm, and preferably is between about 10 μm and 20 μm. The binder comprises polyvinylidene fluoride. The weight percentage of the particles in the binder is between about 85% and 95%.

According to another aspect of the invention, a method of forming a front electrode for an electroluminescent lamp comprising a phosphor particle-containing layer disposed between the front electrode and a corresponding rear electrode that are adapted to apply an excitation potential to the phosphor particles, the front lamp electrode being light transmissive to radiation from the phosphor particles, comprises: depositing over the phosphor layer at least one thin layer of a suspension of light-transmissive polymer solid dispersed in a liquid phase containing a uniform dispersion of discrete gallium-doped zinc oxide particles, and causing the layer to fuse throughout to form a continuous electrode layer.

In preferred embodiments of the method, the light-transmissive polymer comprises polyvinylidene fluoride, and the front electrode is deposited by screen printing techniques.

According to another aspect of the invention, an electroluminescent lamp is prepared according to the above method.

Other features and advantages of the invention will be apparent from the following description of a presently preferred embodiment, and from the claims.

DESCRIPTION OF THE PREFERRED EMBODIMENT

Figure 1A:
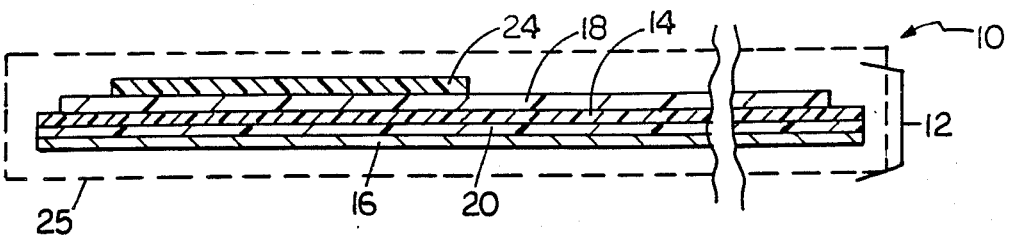
Figure 1B:
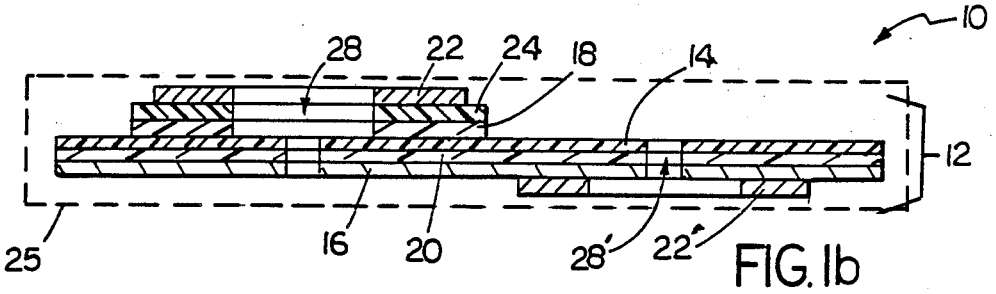
Figure 1:
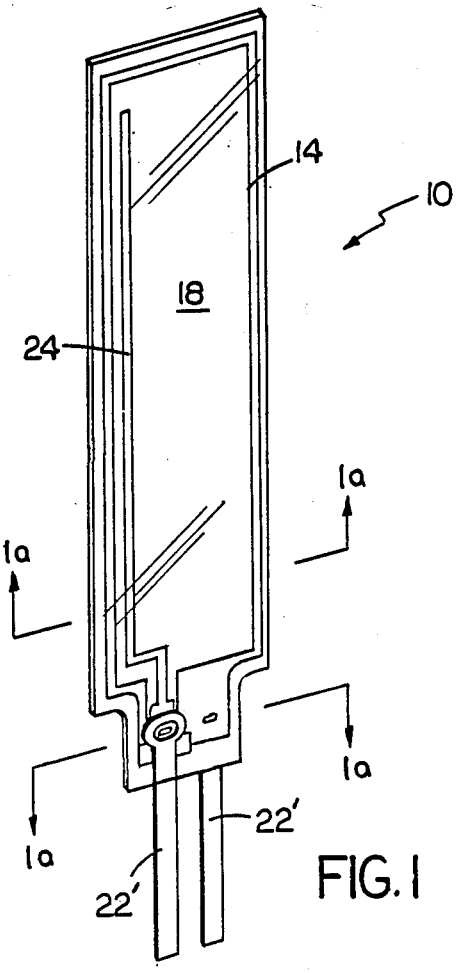

We first briefly describe the drawings:

FIG. 1 is a plan view of an electroluminescent lamp formed according to the invention; and FIGS. 1*a* and 1*b* are cross-sectional perspective views of the lamp shown in FIG. 1 taken at the lines 1*a*—1*a* and 1*b*—1*b* respectively.

Referring to the drawings there is shown an electroluminescent lamp 10 formed of a series of fused superposed layers. Such a lamp is described in Harper et al., U.S. Pat. No. 4,816,717 issued 3/29/89, assigned to the same assignee as the present application and hereby incorporated by reference. Lamp 10 includes a composite 12 having a light emitting phosphor layer 14 disposed between electrodes 16 and 18; front electrode 18 is light transmissive. Lower electrode 16 is an aluminum foil cut to the desired shape and size, e.g., 3 inches by 4 inches.

Composite 12 further includes a dielectric layer 20 separating rear electrode 16 from phosphor layer 14. Copper lead wires 22 and 22 , which are subjacent to each other, contact electrodes 18 and 16, respectively, and are connected to an external power source (not shown) for supplying an excitation potential across phosphor layer 14. Each lead is about 2 mils thick. An electrically conductive bus bar 24, extending to along one edge of electrode 18 and expanding to a pad under lead wire 22, distributes electricity supplied by lead wire 22 to front electrode 18. A moisture barrier 25, through which lead wires 22 and 22' protrude, prevents moisture from penetrating and causing phosphor layer 14 to deteriorate.

Dielectric layer 20, front electrode 18, and phosphor layer 14 (as well as conductive bus bar 24) are all prepared from a polyvinylidene fluoride (PVDF) dispersion commercially available from Pennwalt Corporation under the tradename "Kynar Type 202". Preparing these lamp elements from the same polymeric material helps prevent delamination during use because all of the elements have common thermal expansion characteristics. It also increases the moisture resistance of the lamp because the individual layers interpenetrate and fuse to each other. Moisture barrier 25 is prepared from polychlorotrifluoroethylene.

According to the invention, the front electrode 18 further contains a distribution of discrete gallium-doped zinc oxide particles having an average size of less than about 45 μm and preferably between about 10 μm and 20 μm. The particles, present in the PVDF binder at about 85 to 95 weight percent, cause the front electrode to be electrically conductive while further providing the face of the electroluminescent lamp with a white cast, not possible in prior art electroluminescent lamps without use of nonconductive diffuse cover layers which also reduce significantly the amount of available light transmitted by the lamp. As a result, the transmitted color of the luminescent light emitted by the phosphors with the lamp of the invention in the "on" mode remains white, unaffected by transmission through the front electrode, and the diffuse reflected light of the lamp surface in the "off" mode is also white, serving to mask undesirable colors of lower layers of the lamp.

The lamp 10 is further provided with openings 28 and 28', each having a circular geometry that extends through composite 12, as shown in the drawings. Openings 28 and 28' are occupied by the polymeric material forming moisture barrier 25 so that connections between upper and lower portions of barrier 25 are formed. The diameter of opening 28 through lead wire 22, bus bar 24, and electrode 18 is larger than the corresponding diameter through electrode 16, dielectric layer 20, and phosphor layer 14. Similarly, the diameter of opening 28' through lead wire 22' is larger than the corresponding diameter through phosphor layer 14 and dielectric layer 20. The two openings thereby form a rivet made of the polymeric moisture barrier material. This rivet prevents lead wires 22 and 22' from debonding from electrodes 18 and 16, respectively, when upper and lower portions of the moisture barrier simultaneously expand in opposite directions away from composite 12 when the lamp encounters changes in temperature or humidity.

Lamp 10 was manufactured as follows.

A dielectric composition for forming dielectric layer 20 was prepared by mixing 18.2 grams of barium titanate particles ($BaTiO_6$ supplied by Tam Ceramics, having a particle size less than 5 microns) into 10 grams of Kynar Type 202 (a dispersion containing PVDF in a liquid phase believed to be primarily carbitol acetate). An additional amount of carbitol acetate (4.65 grams) was added to the composition to maintain the level of solids and the viscosity of the composition at a proper level to maintain uniform dispersion of the additive particles while preserving the desired transfer performance.

The composition was poured into 320 mesh polyester screen positioned 0.145 inch above aluminum rear electrode 16 (thickness=3 mil). Due to its high apparent viscosity, the composition remained on the screen without leaking through until the squeegee was passed over the screen exerting shear stress on the fluid composition causing it to shear-thin due to its thixotropic character and pass through the screen to be printed, forming a thin layer on substrate electrode 16 below. The deposited layer was subjected to drying for 2½ minutes at 175° F. to drive off a portion of the liquid phase, and was then subjected to heating to 500° F. (above the initial melting point of the PVDF) and was maintained at that temperature for 45 seconds. This heating drove off remaining liquid phase and also fused the PVDF into a continuous smooth film with $BaTiO_3$ distributed throughout.

The resulting thickness of the dried polymeric layer was 1.0 mil ($1.0\times10^{-3}$ inch).

A second layer of the composition was screen-printed over the first layer on substrate electrode 16, and the resulting structure again subjected to heating for 2½ minutes at 175° F. and a subsequent hot pressing step to consolidate the layers. The final product was a monolithic dielectric unit having a thickness of 2.0 mil with no apparent interface between the layers of polymer, as determined by examination of a cross-section under microscope. The particles of the additive were found to be uniformly distributed throughout the deposit.

The monolithic dielectric unit 20 had a dielectric constant of about 30.

The next step in the manufacture of lamp 10 was the formation of phosphor layer 14. A coating composition was prepared by introducing 18.2 grams of a phosphor additive, zinc sulfide crystal (type #830 from GTE Sylvania, 35 microns), into 10 grams of the Kynar PVDF dispersion used above.

The composition was superposed by screen printing over the underlying insulator layer 20 through a 280 mesh polyester screen positioned 0.145 inch above substrate electrode 16 to form a thin layer. The deposited layer was subjected to the two stage drying and pressing procedure described above. Subjecting the layers to heating and pressing caused the VDF to consolidate throughout the newly applied layer and between the layers to form a monolithic unit upon substrate electrode 16. However, the interpenetration of the material of the adjacent layers having different electrical properties was limited by the process conditions to less than about 5 percent of the thickness of the thicker of the adjacent layers, so that the different electrical property-imparting additive particles remained stratified within the monolithic unit as well as remaining uniformly distributed throughout their respective layers.

The resulting thickness of the dried polymeric layer was 2.0 mils ($2.0\times10^{-3}$ inch).

The deposited film was tested and found to be uniformly luminescent, without significant light or dark spots.

Next, a coating composition for forming transmissive front electrode 18 was prepared. Particles of zinc oxide (at least 95% by weight), gallium oxide (1 to 3% by weight) and ammonium chloride (1 to 2% by weight) were dry mixed and then baked in a loosely capped tube for one hour in an atmosphere of nitrogen at 650° C. The contents of the tube were then ground and fixed in an air atmosphere for 2 hours at 1,100° C. The resulting powder was ground and sieved through 200 mesh to yield particles of gallium-doped zinc oxide having an average size of less than about 45 μm, and preferably between about 10 μm and 20 μm. 40.0 grams of gallium-doped zinc oxide particles (e.g. prepared as described above) were added to 10 grams of the PVDF dispersion described above. (Typically an additional amount of carbitol acetate (0.5 to 2.5 grams) is added to lower the viscosity slightly to enhance transfer properties.)

The composition was superposed onto light-emitting phosphor layer 14 by screen printing through a 280 mesh polyester screen positioned 0.5 inch thereabove. Substrate electrode 16 with the multiple layers coated thereupon was again heated and hot pressed to form a continuous uniform layer and to consolidate this layer together with the underlying light-emitting layer to form a monolithic unit.

The resulting thickness of the dried polymeric layer was 1.0 mil ($1.0\times10^{-3}$ inch).

The deposited layer was tested and found to have conductivity of about 100 ohm-cm, and to be light transmissive to a substantial degree due to the light transmissivity of the gallium-doped zinc oxide particles and of the matrix material. The resulting composite had a white cast, both when the lamp was in the "on" mode and when it was in the "off" mode.

Next, the coating composition for forming a conductive bus 24 to distribute current via relatively short paths to the front electrode was prepared. 15.76 grams of silver flake (from Metz Metallurgical Corporation, of 325 mesh #7 particle size) were added to 10 grams of the PVDF dispersion used above. The particles remained uniformly suspended in the dispersion during the remainder of the process without significant settling.

The composition was screen printed through a 320 mesh polyester screen positioned 0.15 inch above semi-transparent upper electrode 18 as a narrow bar extending alone one edge of the electrode layer. It was expanded to a pad (25 mil×25 mil) in the area of lead wire 22. The deposited layer was subjected to the two stage drying and pressing procedure described above to consolidate the PVDF into a continuous smooth film with the silver flake uniformly distributed throughout.

The resulting thickness of the dried polymeric layer was 1.0 mil ($1.0\times10^{-3}$ inch).

The deposited film was tested and found to have conductivity of $10^{-3}$ ohm-cm.

Openings 28 and 28' were formed as follows. Two openings, each having a diameter of 0.030 in., were drilled through layers 16, 20, and 14. A larger opening (diameter=0.040 in.) was then drilled through bus bar 24 and electrode 18. Next, lead wires 22 and 22', for supplying electricity to lamp 10, were each provided with a 0.040 in. diameter hole and bonded to composite 12 over the holes previously drilled in composite 12 to form opening 28 and 28', respectively.

Next, moisture barrier 25 was formed by covering the exposed surfaces of lamp 10 with a preformed film of polychlorotrifluoroethylene, and then heating the film for one minute at 350° F. while applying a pressure of 125 pounds per square inch. Under these conditions, the film melted and flowed through openings 28 and 28'. The lamp was then cooled while still under pressure.

The final heating step results in electroluminescent lamp 10 of cross-section shown in the figures. The polymeric material that was superposed in layers upon substrate electrode 16 has fused within the layers and between the layers to form a monolithic unit that flexes with the substrate electrode. The upper and lower portions of the polymeric moisture barrier, together with the polymeric material filling openings 28 and 28', form rivets that maintain the bonds between the lead wires and the electrodes, thereby preventing open circuits from forming while the lamp is in use.

Other embodiments are within the following claims, e.g., the contact leads may be attached by other means. Also, the rear electrode 18 may also be formed as a further layer of PVDF binder having conductive particles, e.g. silver flake, as described above is regard to the conductive bus bar 24, dispersed therethrough.

Alternatively, the gallium-doped zinc oxide particles employed in the front electrode may be formed by dry mixing zinc oxide (at least 92.3% by weight) and gallium sulfide (2.25 to 6.7% by weight). The mixture is fired in air at 1,100° C. for one hour. The powder is ground and fired in an oxygen atmosphere for one hour at 1,100° C. After grinding again, the powder is sieved as described above.

What is claimed is:

1. In an electroluminescent lamp comprising a phosphor layer disposed between corresponding lamp electrodes that are adapted to apply an excitation potential to cause said phosphor layer to emit light, the front lamp electrode being light-transmissive to radiation from said phosphor layer, the improvement wherein, said front lamp electrode comprises a thin layer of light-transmissive binder containing a distribution of discrete gallium-doped zinc oxide particles.

2. The electroluminescent lamp of claim 1 wherein the average size of said particles is less than about 45 μm.

3. The electroluminescent lamp of claim 1 wherein the average size of said particles is between about 10μm and 20μm.

4. The electroluminescent lamp of claim 1 wherein said binder comprises polyvinylidene fluoride.

5. The electroluminescent lamp of claim 1 wherein the weight percentage of said particles in said binder is between about 85% and 95%.

6. In an electroluminescent lamp comprising a phosphor layer disposed between corresponding lamp electrodes that are adapted to apply an excitation potential to cause said phosphor layer to emit light, the front lamp electrode being light-transmissive to radiation from said phosphor layer, the improvement wherein said front lamp electrode comprises a thin layer of light-transmissive binder comprising polyvinylidene fluoride containing a distribution of discrete gallium-doped zinc oxide particles of average size between about 10 μm and 20 μm, the weight percentage of said particles present in said binder being between about 85% and 95%.

7. A method of forming a front electrode for an electroluminescent lamp comprising a phosphor-particle-containing layer disposed between said front electrode and a corresponding rear electrode that are adapted to apply an excitation potential to said phosphor particles, the front lamp electrode being light transmissive to radiation from said phosphor particles, said method comprising depositing over said phosphor layer at least one thin layer of a suspension of light-transmissive polymer solid dispersed in a liquid phase containing a uniform dispersion of discrete gallium-doped zinc oxide particles, and causing said layer to fuse throughout to form a continuous electrode layer.

8. The method of claim 7 wherein said light-transmissive polymer comprises polyvinylidene fluoride.

9. A method of forming a front electrode for an electroluminescent lamp comprising a phosphor-particle-containing layer disposed between said front electrode and a corresponding rear electrode that are adapted to apply an excitation potential to said phosphor particles, the front lamp electrode being light transmissive to radiation from said phosphor particles, said method comprising depositing over said phosphor layer, by screen printing techniques, at least one thin layer of a suspension of light-transmissive polymer solid comprising polyvinylidene fluoride dispersed in a liquid phase containing a uniform dispersion of discrete gallium-doped zinc oxide particles, and causing said layer to fuse throughout to form a continuous electrode layer.

10. An electroluminescent lamp prepared according to the method of claim 7 or claim 9.

* * * * *

UNITED STATES PATENT AND TRADEMARK OFFICE

CERTIFICATE OF CORRECTION

PATENT NO. : 4,853,594

DATED : August 1, 1989

INVENTOR(S) : Alan C. Thomas

It is certified that error appears in the above-identified patent and that said Letters Patent is hereby corrected as shown below:

Col. 2, line 27, "22 and 22," should be --22 and 22',--;

Col. 4, line 9, "VDF" should be --PVDF--;

Col. 5, line 46, "is" should be --in--.

Signed and Sealed this

Twenty-ninth Day of May, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,853,594

DATED : August 1, 1989

INVENTOR(S) : Alan C. Thomas

It is certified that error appears in the above-identified patent and that said Letters Patent is hereby corrected as shown below:

Col. 3, line 24, "$BaTiO_6$" should be --$BaTiO_3$--.

Signed and Sealed this

Twenty-eighth Day of August, 1990

*Attest:*

HARRY F. MANBECK, JR.

*Attesting Officer*

*Commissioner of Patents and Trademarks*